US006609703B1

(12) United States Patent
D'Arcy

(10) Patent No.: US 6,609,703 B1
(45) Date of Patent: Aug. 26, 2003

(54) SPINDLE CLAMP SUPPLEMENTAL STAIR RAIL SUPPORT

(76) Inventor: Kevin Paul D'Arcy, 764 Limekiln Pike, Doylestown, PA (US) 18901

( * ) Notice: Subject to any disclaimer, the term of this patent is extended or adjusted under 35 U.S.C. 154(b) by 0 days.

(21) Appl. No.: 10/083,271

(22) Filed: Feb. 25, 2002

(51) Int. Cl.[7] ..... E04H 17/14
(52) U.S. Cl. ..... 256/59; 52/184; 256/65.16
(58) Field of Search ..... 248/226.11, 229.11, 248/227.1, 227.2; 52/184; 256/59, 65.16; 403/286, 373, 256, 257

(56) References Cited

U.S. PATENT DOCUMENTS

| | | | | | |
|---|---|---|---|---|---|
| 1,785,487 | A | | 12/1930 | McAvoy | 49/70 |
| 3,005,242 | A | | 10/1961 | Roberts | 248/62 |
| 4,556,201 | A | | 12/1985 | Turner | 256/59 |
| RE33,975 | E | * | 6/1992 | Asplund et al. | 29/464 |
| 5,337,528 | A | | 8/1994 | Jaworski et al. | 52/182 |
| 5,853,166 | A | | 12/1998 | Koza | 256/59 |
| 6,209,854 | B1 | | 4/2001 | Sedlack et al. | 256/59 |

* cited by examiner

*Primary Examiner*—Ramon O. Ramirez
(74) *Attorney, Agent, or Firm*—Duane Morris LLP

(57) ABSTRACT

A spindle clamp supports a supplemental or kiddie stair rail by clamping onto mutually adjacent stair rail support spindles. In one embodiment, the clamp holds a conventional stair rail support bracket. A kit of parts includes a plurality of such spindle clamp supplemental stair rails supports.

7 Claims, 11 Drawing Sheets

352a
354a
350
352b
354b
340
310
326
324
320
360
308W2
314fs
322
322a
315
308W1
312
313
314rs
308L2
W
230a
T
L
312b
312f
308L1
312
308L1
314rs
314
314fs
312b
312f
312
320

SPINDLE CLAMP SUPPLEMENTAL STAIR RAIL SUPPORT

FIELD OF THE INVENTION

This invention relates to stair rail supports, and more particularly to such supports which are adapted to be clamped to existing stair rail spindles.

BACKGROUND OF THE INVENTION

More attention is currently being addressed toward child safety than may have been the case in the past. Among the areas of safety concern are the possibility of a toddler's fall when traversing steps, such as steps leading from one floor of a dwelling to another. In general, very small children can be prevented from obtaining access to steps by the use of temporary gates which are located so as to prevent child access to the stairs. As noted by Turner in U.S. Pat. No. 4,556,201, such gates are inconvenient to adults. Such gates may be necessary when the child is in the crawling or toddler stage and completely unable to navigate the steps. At a somewhat older stage, children can navigate stairs with the assistance of an adult. However, gates prevent a child around this stage of development from accessing the stairs, and thus not only prevent the child from learning to navigate steps on their own, but also inconveniently require that an adult or older child be present whenever the child wishes to traverse the stairs.

When a child reaches the stage of being able to navigate stairs with assistance, it is very advantageous to have a stair rail at a height which the child can reach, so that they learn to hold a rail during the traverse. Most adult stair rails are too high for such a child, so that learning is impaired, and adult or older-child assistance is required for a longer time than may be advantageous. For this reason, various arrangements for child stair rails are suggested by the abovementioned Turner patent and others.

The Turner patent relates to an elongated vertically oriented supplemental support which bears a conventional rail support at its bottom. Such a conventional rail support is readily available, and includes a metal rosette monolithic with a projecting angled bracket. The rosette defines two or three screw holes, for being fastened by a corresponding number of screws to a stud in conventional stud/wallboard construction, with the rosette lying flat against the wallboard. The projecting angled bracket provides a horizontally-disposed portion which, when in use, lies against the lower portion of a wooden stair rail. The conventional rail support is also ordinarily supplied with a separate clamp formed to the shape of the horizontally-disposed portion of the angle bracket, which is mounted under the horizontally-disposed portion and screwed to the underside of the stair rail. The rosette/angled-bracket part of the conventional rail support is illustrated as item 12 in the Turner patent, and its horizontally disposed portion is illustrated as 62. The clamp is illustrated as 60. The Turner patent contemplates the use of a plurality of such vertically oriented supplemental supports. To attach the vertically oriented supplemental support to a wall, the original conventional rail supports are removed from the wall, which leaves holes in the wallboard. The vertically oriented supplemental support is mounted with preformed holes in its upper portion overlying the exposed holes in the wallboard. The original conventional rail support is placed over the preformed holes, and the vertically oriented support is fastened in place by means of screws which extend through the previously-removed upper conventional rail support, the preformed holes in the supplemental vertically oriented support, and into the wall. Thus, the holes in the wall are covered. Two or more such vertically oriented supports are mounted at spaced-apart locations, so that sets of conventional rail supports are available for supporting a stair rail. The original stair rail can then be affixed to the upper set of conventional rail supports, and the new child stair rail can be affixed to the lower set of conventional rail supports.

A shaped metal bracket is described by Roberts in U.S. Pat. No. 3,005,242. The metal bracket is screwed to the underside of the adult stair rail, and projects downward to support a child rail. U.S. Pat. Nos. 5,337,528, 5,853,166, and 6,209,854 describe supplemental or child rail supports which clamp in various ways to the adult stair rail. U.S. Pat. No. 1,785,487 issued Dec. 16, 1930 in the name of McAvoy describes an arrangement including an elongated vertically oriented piece which holds two rails, which aid in clamping a gate in a stairway.

Improved supplemental rail support arrangements are desired.

SUMMARY OF THE INVENTION

A spindle clamp according to an aspect of the invention is for supporting a supplemental stair rail by means of at least one vertically oriented stair rail spindle. The spindle clamp includes a generally planar first body portion defining a first length along a length axis, a first width along a width axis, and a first thickness which may be less than either the first length or the first width, so as to define first and second broad surfaces. The first width of the first body portion is of a dimension which is less than the inter-spindle dimension of the spaced-apart, mutually parallel stair-rail spindles, so that the first body portion, when oriented with the length axis parallel with the spindles and with the plane of first body portion parallel with a plane containing the axes of the spindles, can pass between the spindles. The first body portion also includes one portion of a fastening device. A generally planar second body portion defines a second length along a length axis, a second width along a width axis, and a second thickness which may be less than either the second length or the second width so as to define first and second broad surfaces. The second body portion also includes a second portion of the fastening device. The fastening device, when in use, tends to draw the first surface of the first body portion toward the first surface of the second body portion, whereby, when the first body portion is located on one side of the plane containing the axes of the spindles and the second body portion is located on the other side of the plane containing the axes of the spindles, with a spindle therebetween, operating the fastening device tends to tighten the first and second body portions against opposite sides of the spindle to thereby stabilize the spindle clamp. The spindle clamp further includes a rail support element projecting from the second side of one of the first and second body portions, for engaging a stair rail.

A spindle clamp according to another aspect of the invention is for supporting a supplemental stair rail by means of, or with the aid of, spaced-apart, mutually parallel, vertically oriented stair rail spindles. The spindle clamp includes first and second body portions and a projecting rail support. The first body portion defines a first length along (parallel with) a length axis, a first width along (parallel with) a width axis, and a first thickness which may be less than either the first length or the first width, so as to define a generally planar structure with first and second broad surfaces. In one embodiment of the invention, the first width of the first body portion is a dimension which is less than the inter-spindle dimension of the spaced-apart, mutually parallel stair-rail spindles, so that the first body portion, when oriented with its length axis parallel with the spindles and with the plane of first body portion parallel with a plane containing the axes of the spindles, can pass between the spindles. The first length of the first body portion in this embodiment is greater than the inter-spindle dimension, so that the first body portion, when oriented with the first width axis parallel with the spindles, cannot pass between the spindles. The first body portion also includes one portion of a fastening device. In a particular embodiment, the portion is one of a clearance aperture for a screw and a threaded aperture for the screw.

The second body portion of the spindle clamp in this other aspect of the invention is also generally planar, and defines a second length along a length axis, a second width along a width axis, and a second thickness which may be less than either the second length or the second width so as to define first and second broad surfaces. The second body portion also includes a second portion of the fastening device, which in the one embodiment is the other one of the through and the threaded aperture for the screw. The fastening device, when in use, tends to draw the first surface of the first body portion toward the second surface of the second body portion, whereby, when the first body portion is located on one side of the plane containing the axes of the spindles and the second body portion is located on the other side of the plane containing the axes of the spindles with at least one spindle located therebetween, operating the fastening device tends to tighten the first and second body portions against opposite sides of the spindles and thereby stabilize the spindle clamp. The spindle clamp further comprises a rail support element projecting from one of the second side of the first body portion and the first side of the second body portion for engaging a stair rail. Most applications will require a set of two or more such spindle clamps, or at least one such spindle clamp and a wall-mount support.

A method according to another aspect of the invention is for mounting a spindle clamp for supporting a supplemental stair rail by means of spaced-apart, mutually parallel, vertically oriented stair rail spindles, where each stair rail spindle defines an axis, and the axes together define at least a local spindle plane. Each spindle clamp includes (a) a first body portion, (b) a second body portion, and (c) a rail support. The first body portion is generally planar, and defines a first length along a length axis, a first width along a width axis, and a first thickness which may be less than either the first length or the first width, so as to define first and second broad surfaces. The first width of the first body portion is a dimension which is less than the inter-spindle dimension of the spaced-apart, mutually parallel stair-rail spindles, so that the first body portion, when oriented with the length axis parallel with the spindles and the plane of first body portion parallel with a plane containing the axes of the spindles, can pass between the spindles. The first length of the first body portion is greater than the inter-spindle dimension, so that the first body portion, when oriented with the length axis perpendicular with the spindles and parallel with the spindle plane, cannot pass between the spindles. The first body portion also includes one portion of a fastening device The second body portion is generally planar, and defines a second length along a length axis, a second width along a width axis, and a second thickness which may be less than either the second length or the second width so as to define first and second broad surfaces. The second body portion also includes a second portion of the fastening device. The fastening device, when in use, tends to draw the first surface of the first body portion toward the first surface of the second body portion, so that, or whereby, when the first body portion is located on one side of the plane containing the axes of the spindles and the second body portion is located on the other side of the plane containing the axes of the spindles, operating the fastening device tends to tighten the first and second body portions against opposite sides of the spindles and thereby stabilizes the spindle clamp. The spindle clamp further includes a rail support element projecting from the second side of one of the first and second body portions, for engaging a stair rail. The method comprising the step of placing the first body portion adjacent the spindle plane, roughly between two mutually adjacent spindles, with the first length axis parallel with the axes of the spindles. The next step includes moving the first body portion perpendicularly toward and through the spindle plane, without causing the second body portion to pass through the spindle plane. The first body portion is rotated so as to bring the first length axis perpendicular to the spindle axes and parallel with the spindle plane, whereby at least one of the spindles lies adjacent the first body portion. In general, this rotation of the first body portion constitutes rotation in the plane of the first body portion. The second body portion is placed in a position in which the second length axis is roughly parallel with the first length axis, and on the opposite side of the spindle plane from the first body portion, if the second body portion is not already in such a position. In the given positions, the at least one of the spindles lies between the first and second body portions. The fastening device is then operated or tightened to thereby draw the first and second body portions toward each other with the at least one of the spindles located between the first and second body portions, to thereby fasten the spindle clamp to the at least one spindle. A stair rail can then be fastened to the rail support element.

DESCRIPTION OF THE INVENTION

According to an aspect of the invention, a child rail can be placed on a stairway in regions where the regular or adult stair rail is supported by vertically-disposed spindles which extend vertically from below, as for example from the various stair steps to the rail. According to an aspect of the invention, the supplemental rail support clamps to at least one, and preferably to two or more mutually adjacent spindles and supports a separate conventional rail support, or is integrally monolithic with a projecting angle bracket equivalent to that of a conventional rail support.

Figure 1:
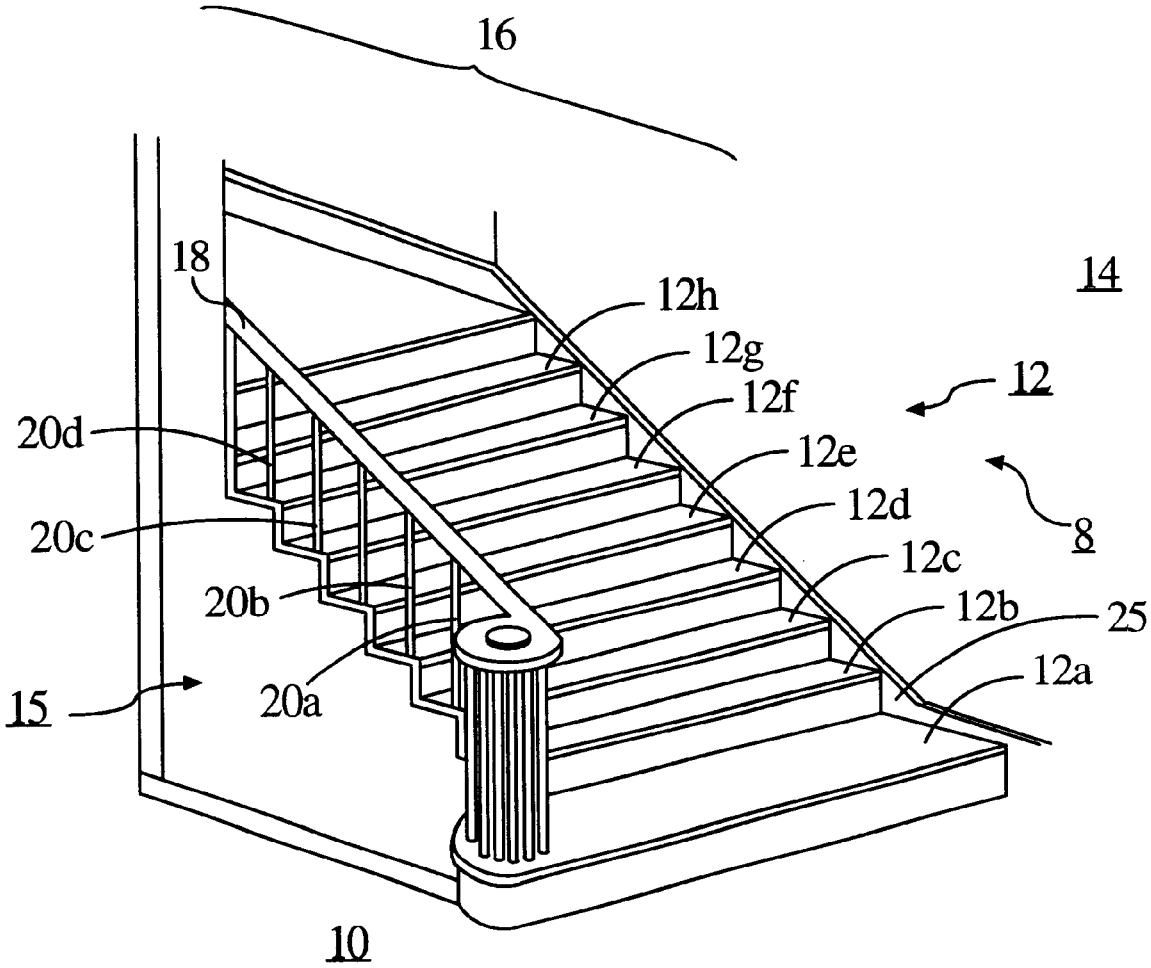
FIG. 1 is a simplified perspective or isometric view of a stairway set in a stairwell.

FIG. 1 is a simplified perspective or isometric view of a stairway 10 set in a stairwell 8. In FIG. 1, a set 12 of stairsteps 12*a*, 12*b*, 12*c*, 12*d*, 12*e*, 12*f*, 12*g*, and 12*h* runs along an "inside" wall 14, which defines one side of the stairwell 8. Along at least a portion 16 of the length of the stairway 10, the "outside" or open portion of the stairwell 8 is protected by a conventional stair rail 18 supported by a set 20 of vertically disposed, mutually parallel, elongated spindles or stiles 20*a*, 20*b*, 20*c*, and 20*d*, which rest on the various stairsteps of set 12 of stairsteps. As illustrated, one spindle of set 20 of spindles is associated with one stairstep of set 12 of stairsteps, but each stairstep may be associated with more than one spindle, or there may be some stairsteps which lack a spindle. A decorative trim piece 25 extends parallel with the stairwell along the inside wall. For purposes of generality, a second wall 15 is illustrated as defining a portion of the stairwell 8.

Some standards set specifications for the dimensions between spindles. One such specification requires that a sphere or ball having a diameter of four inches not be able to pass between adjacent spindles, and an older standard specified a six-inch sphere. Clearly, the diameter of the spindles will affect the inter-axis spacing of the spindles when such a specification is to be met, as very thin spindles may require closer spindle-to-spindle spacing than very fat spindles. For spindles which are turned so as to vary in diameter along their lengths, the relative locations of thick and thin portions of the turnings along the lengths may also affect the minimum spindle spacing, as the stair rise may juxtapose a thick portion of one spindle with the thin portion of an adjacent spindle, or may instead result in juxtaposition of two thin spindle portions. Thus, the actual spindle spacing which may be encountered may vary depending upon the age of the stairway and the standard to which it was designed, and may also vary depending upon the spindle shape and stair rise.

Figure 2:
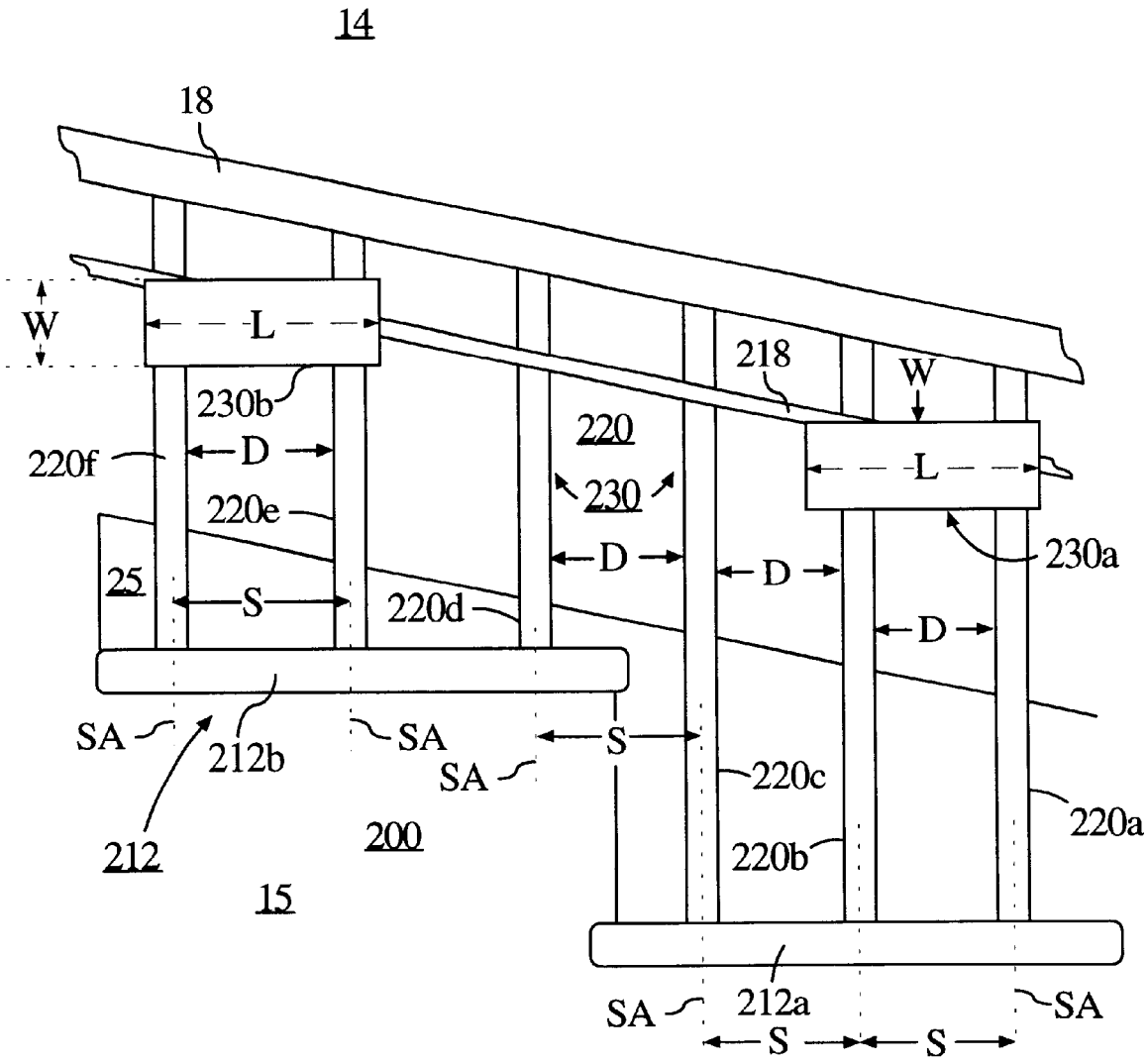
FIG. 2 is a simplified elevation view of a portion of a stairway similar to that of FIG. 1 including a set of steps and a set of rail support spindles.

According to an aspect of the invention, a supplemental stair rail support for use in a stair region in which the adult or regular stair rail is supported by spindles includes a clamp which clamps to at least two adjacent spindles. FIG. 2 is a simplified elevation view of a portion 200 of a stairway including a set 212 of steps and a set 220 of spindles. Two stairsteps 212*a* and 212*b* are illustrated in FIG. 2, together with vertically disposed, mutually parallel spindles or stiles 220*a*, 220*b*, 220*c*, 220*d*, 220*e*, and 220*f* supporting regular or adult stair rail 18. Each spindle of set 220 of spindles of FIG. 2 may be viewed as having a central spindle axis SA. The spindles 220*a*, 220*b*, 220*c*, 220*d*, 220*e*, and 220*f* of set 220 are regularly spaced in the horizontal direction a center-to-center spacing S between adjacent axes SA. The spindle-to-spindle distance D between the outer sides of the spindles will be less than the center-to-center spacing S.

According to an aspect of the invention, a set 230 of supports 230*a*, 230*b* provides support for a supplemental or child stair rail 218 by ultimately supporting the supplemental stair rail 218 with or to at least some of the spindles of set 220 of spindles. As illustrated in FIG. 2, the supports 230*a* and 230*b* have a generally elongated shape, with a projected length L and a projected width W. In a particular version of the invention, the width W is selected to be no greater than the spindle-to-spindle dimension D, and the length is selected to be substantially greater than the spindle-to-spindle dimension D, and preferably greater than the center-to-center spacing S.

Figures 3A, 3B, 3C:
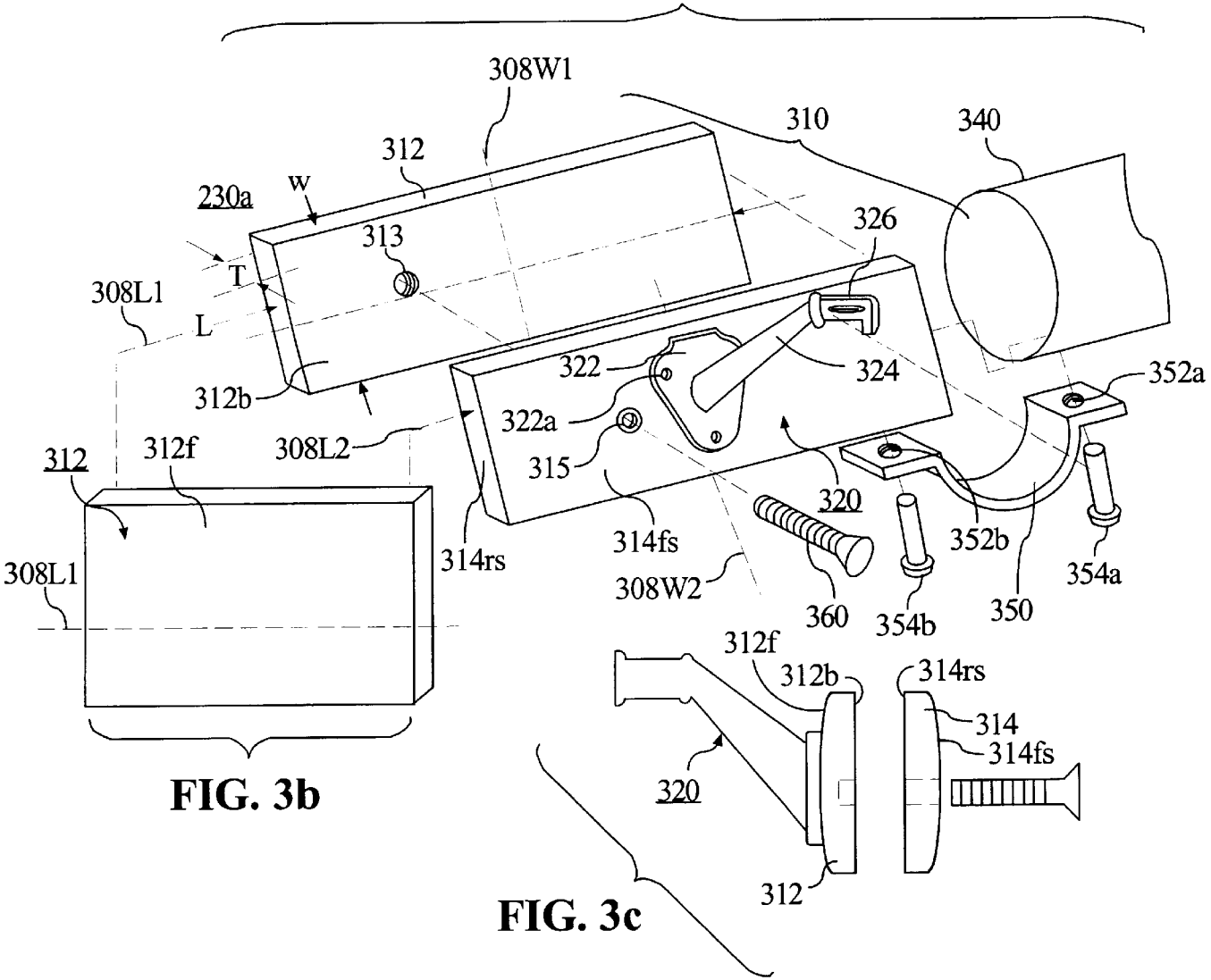
FIG. 3*a* is an exploded perspective or isometric view of a supplemental rail support according to one embodiment of the invention, which support includes first and second body portions.
FIG. 3*b* illustrates the reverse side of a body portion of FIG. 3*a*.
FIG. 3*c* illustrates another embodiment of a supplemental rail support according to an aspect of the invention.

FIGS. 3*a* and 3*b* illustrate a first embodiment of a clamp-type support which can be used as support 230*a* of FIG. 2. In FIG. 3*a*, the body 310 of the support includes a first portion 312, which is basically a generally planar body defining an axis 308L1 of elongation and an axis 308W orthogonal to length axis 308L1. The length of first body portion 312 along the length axis 308L1 is defined as L. The principal width along the axis 308W is defined as W. FIG. 3*b* illustrates the reverse side of first body portion 312.

Second body portion 314 of body 310 of FIG. 3*a* is also illustrated as having a generally planar shape similar to that of the first body portion, with a length axis 308L2 and a width axis 308W2. In FIG. 3*a*, second body portion 314 bears a conventional stair rail support 320. Conventional stair rail support 320 includes a rosette portion 322 which, in use, lies against the front broad surface 314*fs*, and is affixed thereto by means of screws (not illustrated) which extend through a plurality of apertures, one of which is designated 322*a*, and into the second body portion 314. As described above, conventional stair rail support 320 also includes an extending angle bracket 324/326 which is monolithically integral with the rosette 322. In use with a supplemental stair rail, a portion of which is illustrated as 340 in FIG. 3*a*, the bottom of the supplemental rail 340 lies against the upper edge of angle bracket portion 326. The supplemental stair rail 340 is held in place against angle bracket portion 326 by means of a conventional stair rail support clamp illustrated as 350. Clamp 350 defines two apertures or holes 352*a*, 352*b* through which attachment,screws 354*a* and 354*b*, respectively, can pass and extend into supplemental stair rail 340.

Attachment of the first body portion 312 to the second body portion 314 of supplemental stair rail support or clamp 230*a* of FIGS. 3*a* and 3*b* is provided by a threaded closed-end aperture 313 in back surface 312*b*, which aperture is registered with a through aperture 315 extending between front surface 314*fs* and rear surface 314*rs* of second body portion 314, together with an appropriate screw illustrated as 360. The closed-end threaded aperture 313 may be made by drilling a closed-end hole in the appropriate location and inserting a threaded insert into the hole, or a through hole may be drilled and fitted with a threaded insert, following which a filler material is placed in that end of the hole which it is desired to close. Alternatively, the base material itself may be threaded, if the first body portion is made from an appropriate material.

FIG. 3*c* is a simplified elevation view of the ends of the body portions of FIGS. 3*a* and 3*b*, illustrating an alternative embodiment in which the rail support is mounted on the reverse side of the spindle clamp. Since the spindle clamp structure can be essentially bilateral or symmetric, the rail support can be on either side.

Figure 4A:
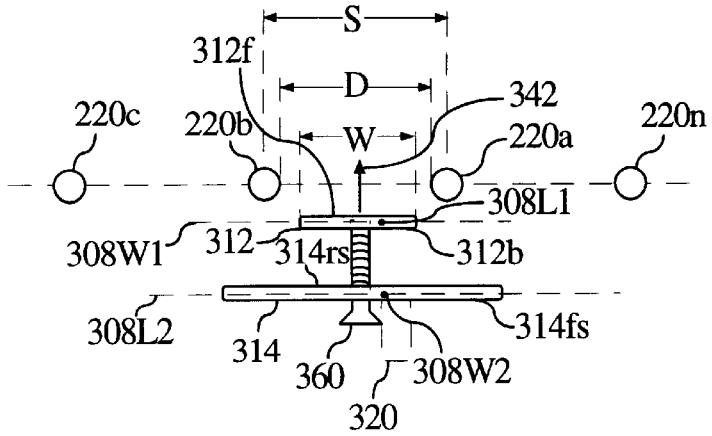
FIGS. 4*a*, 4*b*, 4*c*, and 4*d* are cross-sectional views of a stair rail support spindle arrangement similar to that of FIG. 2, illustrating various steps in the mounting of a supplemental stair rail support in accordance with an aspect of the invention.
Figure 4B:
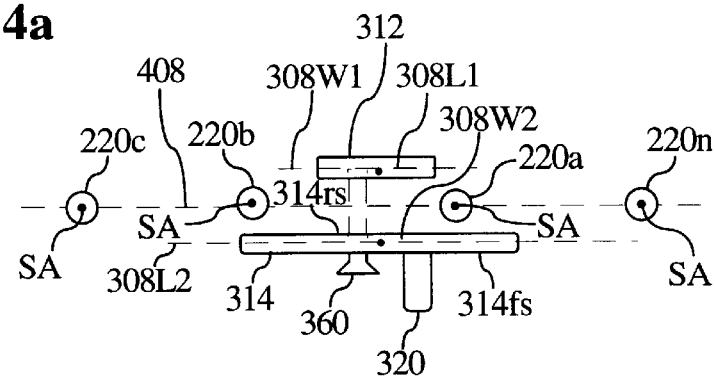
Figure 4C:
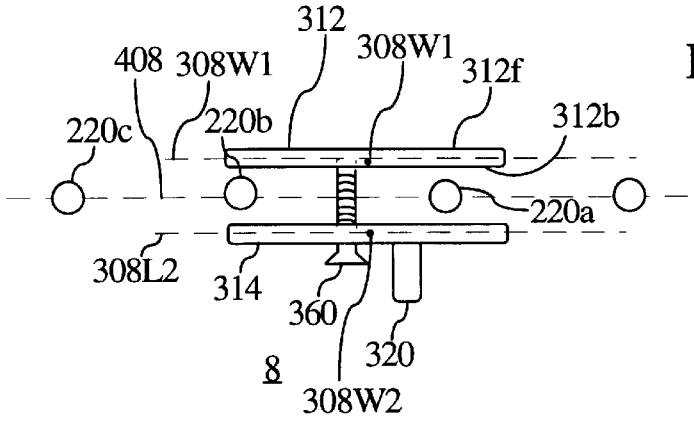
Figure 4D:
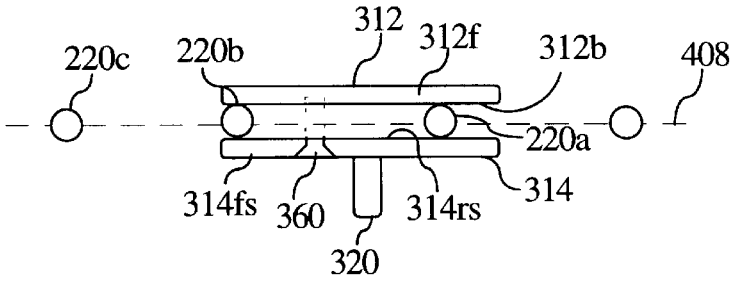

Installation of a supplemental stair rail support or clamp such as clamp 230*a* of set 230 of clamps may be accomplished in two different ways. If the width W of the first body portion 312 of FIG. 3*a* is no larger than the spindle-to-spindle dimension D of FIG. 2, and the length dimension L is greater than D, the screw 360 of FIG. 3*a* can be passed through aperture 315 and engaged loosely in threaded aperture 313, to loosely connect the first and second body portions 312 and 314, respectively. The first body portion 312 is then oriented with its length axis 308L1 parallel with the spindles of the stair to which it is to be attached, and passed through the gap between spindles and past the plane 408 including the spindle axes SA, as suggested by arrow 342 of FIG. 4*a*. The second body portion 314 is kept on that side of the plane 408 which faces the stairwell 8. The resulting position is illustrated in FIG. 4*b*. The first and second body portions 312 and 314 of FIGS. 3*a* and 3*b* are then oriented with their length axes 308L1 and 308L2 either horizontal, as illustrated in FIGS. 2 and 4*c*, or parallel with the slope of the stair step set 12. The screw 360 is then tightened, to draw the first body portion 312 toward second body portion 314, to thereby clamp the two adjacent spindles, namely spindles 220*a* and 220*b*, between the body portions, as illustrated in FIG. 4*d*.

Those faces of the supplemental stair rail support or clamp 230*a* of FIGS. 3*a* and 4*a*–4*d* (where the hyphen represents the word "through") do not need to be flat surfaces. They may be ridged or otherwise formed so as to better grip the spindles, and they may be coated or surfaced with either or both of an anti-slip material and a soft material to prevent damage to the spindles. A material which is both soft and anti-slip is an elastomer such as rubber.

An alternative way to join the first body portion 312 and the second body portion 314 of supplemental stair rail support 230*a* of FIGS. 3*a* and 3*b* to a set of spindles is to simply separate the two body portions if not already separated, place the first body portion on the outside of the spindle set, and the second body portion on the inside of the spindle set opposite to the first body portion, with their axes of elongation 308L1 and 308L2 horizontal (or parallel with the slope of the stair). The screw 360 is then used to press the two halves of the body together with at least a pair of spindles therebetween.

Figure 5A:
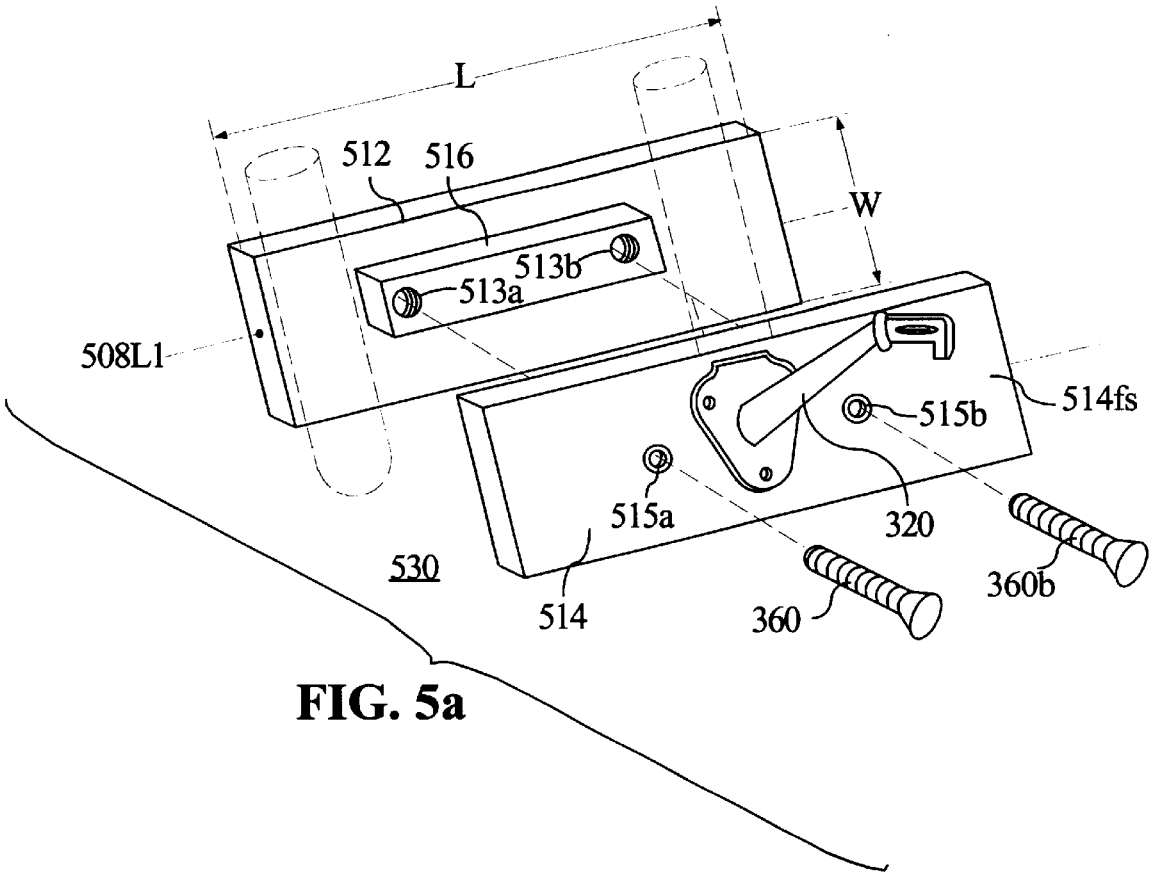
FIG. 5*a* is a perspective or isometric view of a supplemental stair rail support similar to that of FIG. 3*a*, illustrating a block affixed between body portions.

FIG. 5*a* illustrates a modified supplemental stair rail support 530, in which a block is fitted between the first and second body portions of the stair rail support. In FIG. 5*a*, first body portion 512 is similar to first body portion 312 of FIG. 3*a*, but includes a block designated. 516 affixed in a roughly central location, as for example by screws or glue (not illustrated). Block 516 is large enough to accommodate a pair of threaded apertures 513*a* and 513*b*. Second body portion 514 of FIG. 5*a* is similar to second body portion 314 of FIG. 3*a*, but defines first and second through apertures 515*a*, 515*b*, which are registered with threaded apertures 513*a* and 513*b*, respectively. Through apertures 515*a* and 515*b* are dimensioned to clear connecting screws 360*a* and 360*b*.

Figure 5E:
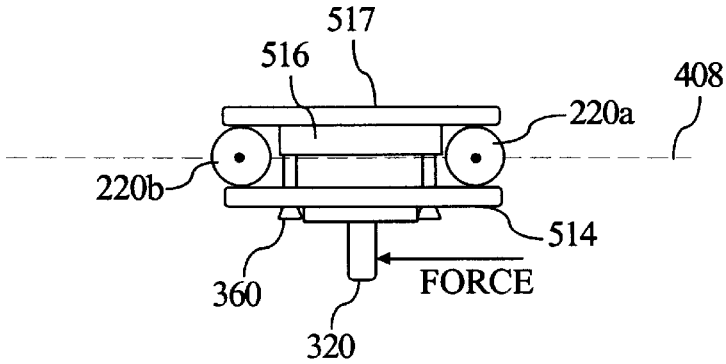
FIG. 5*e* is a cross-sectional view of a stair rail support spindle arrangement similar to that of FIG. 3*c*, showing the location of the block of FIG. 5*a* between adjacent spindles when mounted by the method of FIGS. 5*b*, 5*c*, and 5*d*, or by an other method.

The supplemental rail support 530 of FIG. 5*a* may be mounted to a spindle system by simply disassembling the two body portions 512, 514 from each other, placing the two body portions on opposite sides of the plane of the spindle system, and reassembling the body portions, to directly achieve the position illustrated in FIG. 5*e*. As an alternative, the width dimension W of one of the body portions 512 or 514 (or both) may be selected to be less than the spindle-to-spindle dimension D, and the steps illustrated in FIGS. 5*b* through 5*d* may be taken to insert the supplemental rail support 530 between the rails, ready for tightening of the screws 360, 360*b*, without disassembly of the two body portions.

Figure 5B:
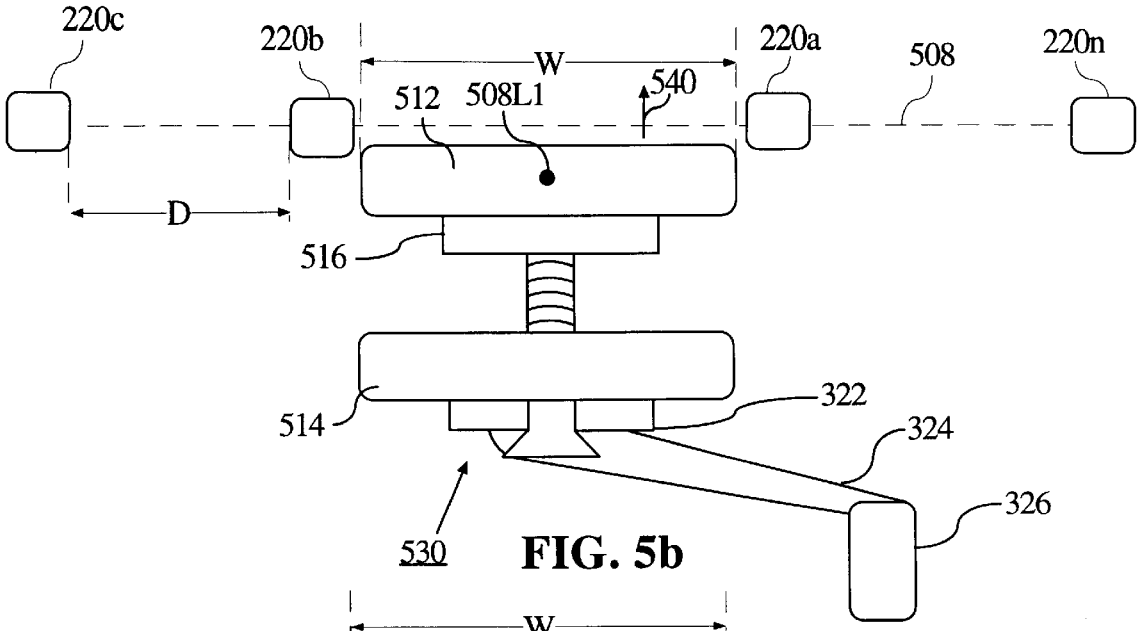
FIGS. 5*b*, 5*c*, and 5*d* are cross-sectional views of a stair rail support spindle arrangement similar to that of FIG. 2, illustrating various steps in the mounting of the supplemental stair rail support of FIG. 5*a*, without disassembly of the supplemental rail support of FIG. 5*a*, all in accordance with an aspect of the invention.
Figure 5C:
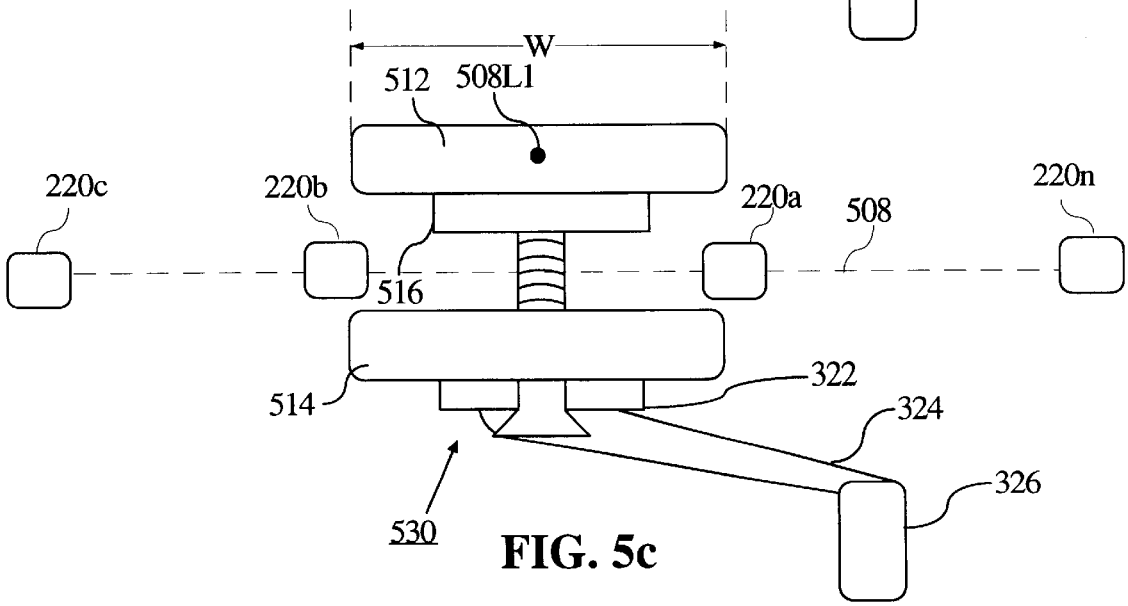
Figure 5D:
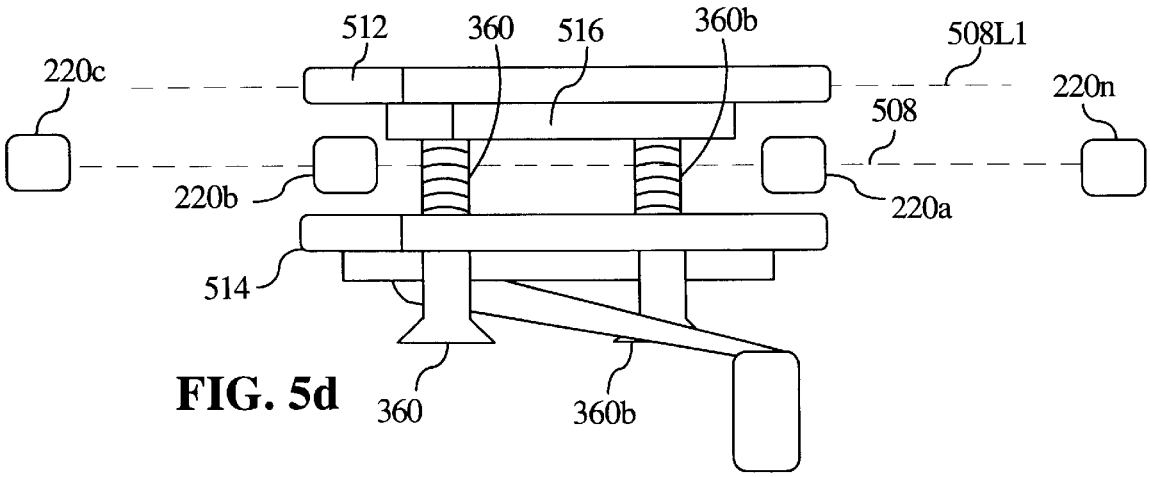

FIGS. 5*b*, 5*c*, and 5*d* are cross-sectional views of a stair rail support spindle arrangement similar to that of FIG. 2, illustrating various steps in the mounting of the supplemental stair rail support of FIG. 5*a*, without disassembly of the supplemental rail support 530 of FIG. 5*a*, all in accordance with an aspect of the invention. In FIG. 5*b*, supplemental rail support 530 is located on one side of the plane 508 of the stair rail support spindles 220*a*, 220*b*, 220*c*, . . . , 220N, with the longitudinal axis 508L1 of body portion 512 oriented vertically or parallel with the spindle axes. The body portion 512, together with the remainder of the supplemental rail support 530 (depending upon how tightly the screws 360, 360*b* hold the two body portions together) is moved in the direction of arrow 540, through to the other side of plane 508 of the spindles. The resulting position of the supplemental rail support 530 is illustrated in FIG. 5*c*. The supplemental rail support 530 is then rotated as a whole, so as to rotate the longitudinal axis 508L1 of body portion 512 toward the horizontal, as suggested in FIG. 5*d*. Additional rotation from the position illustrated in FIG. 5*d* brings the longitudinal axis 508L1 of body portion 512 horizontal, and the screws may then be tightened to achieve the state illustrated in FIG. 5*e*.

FIG. 5*e* is an elevation cross-sectional view illustrating how the supplemental rail support 530 of FIG. 5*a* is mounted to two adjacent spindles. In FIG. 5*e*, block 516 is located between spindles 220*a* and 220*b*. A force applied to conventional rail support 320 in the direction indicated by the FORCE arrow tends to slide the supplemental stair rail support away from a centered position between the spindles. One purpose of block 516 is to stop excessive horizontal or transverse movement of the supplemental stair rail support 530 if the forces acting thereon are sufficient to cause it to slide. In the absence of block 516, the movement would continue until one of the screws came into contact with the adjacent spindle. Under such circumstances, the threads of the screw would come into contact with the spindle surface, and might cause damage to the spindle. The smooth surfaces of the block tend to minimize such damage. In addition, the thickness of the block 516 provides a greater purchase for the threads of the screw. Yet further, the presence of block 516 can stop the supplemental stair rail support from loosing its clamping action by slipping free of one of the spindles. The block 516 may, of course, be mounted on the second body portion 514 instead of on body portion 512, and in that location can perform some of those functions.

Figures 6A, 6B:
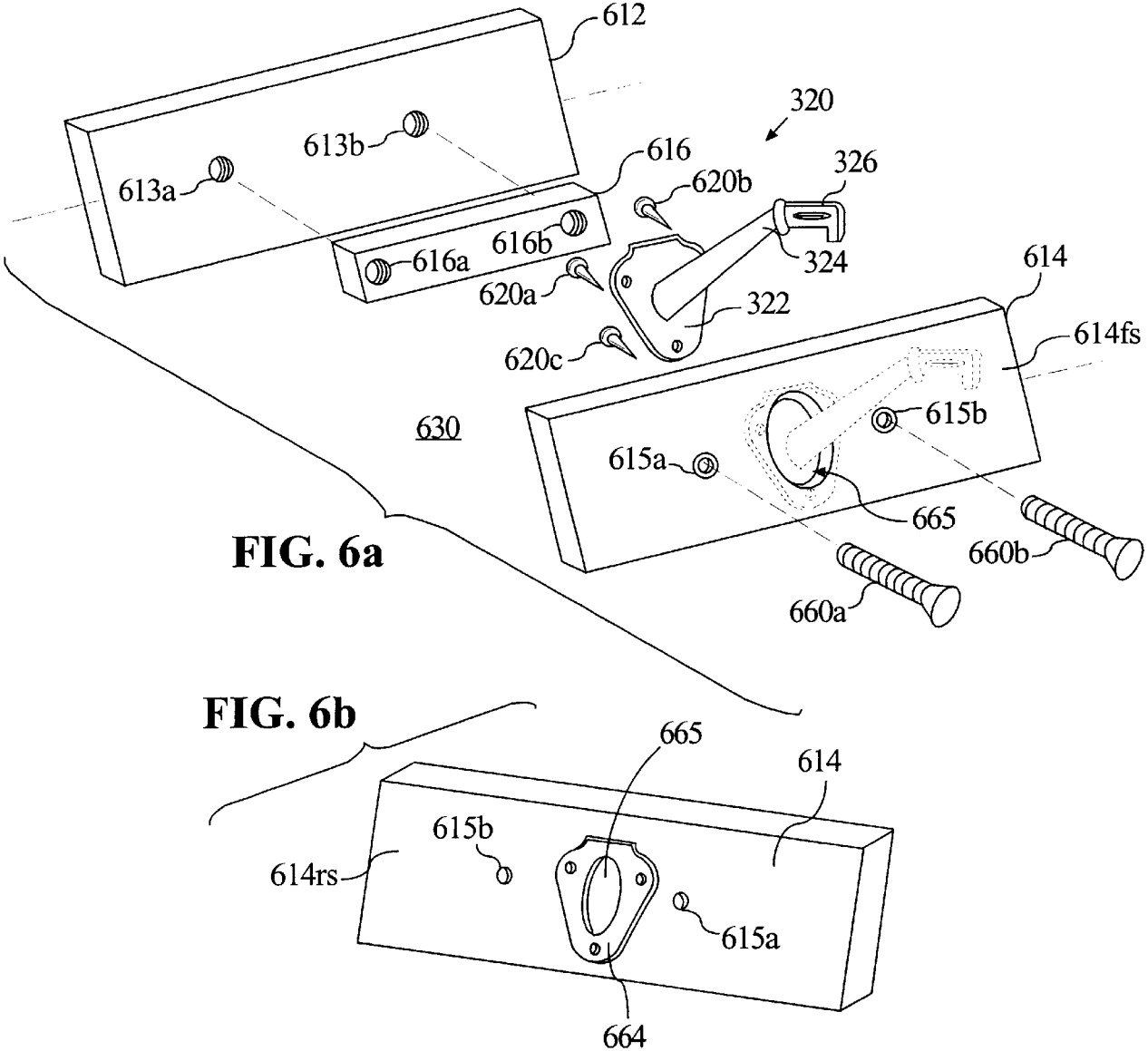
FIG. 6*a* is a perspective or isometric view of an exploded supplemental stair rail support arrangement according to an aspect of the invention, showing how a spindle clamp body portion can be arranged to receive a standard stair rail support so as to strengthen the structure.
FIG. 6*b* illustrates the reverse side of the spindle clamp body portion showing the routed or cut-out portion to accept the rosette of the conventional stair rail support.

Conventional rail supports such as those described by Turner are generally relatively inexpensive castings, which are not very thick, and which may be made from zinc or some other metal not noted for its strength. Thus, they may have limited strength. In addition, the screw clearance apertures which are defined in the conventional rail supports are relatively small, possibly because a larger casting would be required to provide larger through holes. As a result, conventional rail supports may accept only relatively small support or mounting screws. In order to enhance the strength of the supplemental stair rail support, a modified design may be desirable. FIG. 6*a* is an exploded view of a supplemental stair rail support 630 including a first body portion 612 and a second body portion 614, both generally similar to those described in conjunction with FIGS. 3*a* and 5*a*. The two body portions 612 and 614 are held together by a pair of screws 660*a* and 660*b*, which extend through a pair of through clearance apertures 615*a* and 615*b* of second body portion 614, respectively, through clearance apertures 616*a* and 616*b*, respectively, in a block 616, and into threaded apertures 613*a* and 613*b*, respectively, in first body portion 612. As illustrated in FIG. 6*b*, the rear surface 614*rs* of second body portion 614 is routed or otherwise formed with a depressed region 664 having the same shape as the support flange or rosette 322 of the conventional stair rail support 320. In an appropriate location within the depressed portion 664 of FIG. 6*b*, a through aperture 665 provides clearance for the projecting angle bracket portion 324/326. The rosette or flange 322 of the conventional stair rail support 320 is fastened into place within depressed portion 664, with the angle bracket 324/326 projecting through aperture 665. A set of screws 620*a*, 620*b*, and 620*c* may be used to fasten the conventional stair rail support 320 in place. As an alternative, adhesive may be used to fasten it in place, or both may be used. Additional strength is obtained if the block 616 of FIG. 6*a* is fastened over the rosette 322 and depressed portion 664, and itself fastened in place with adhesive or screws.

Figure 7A:
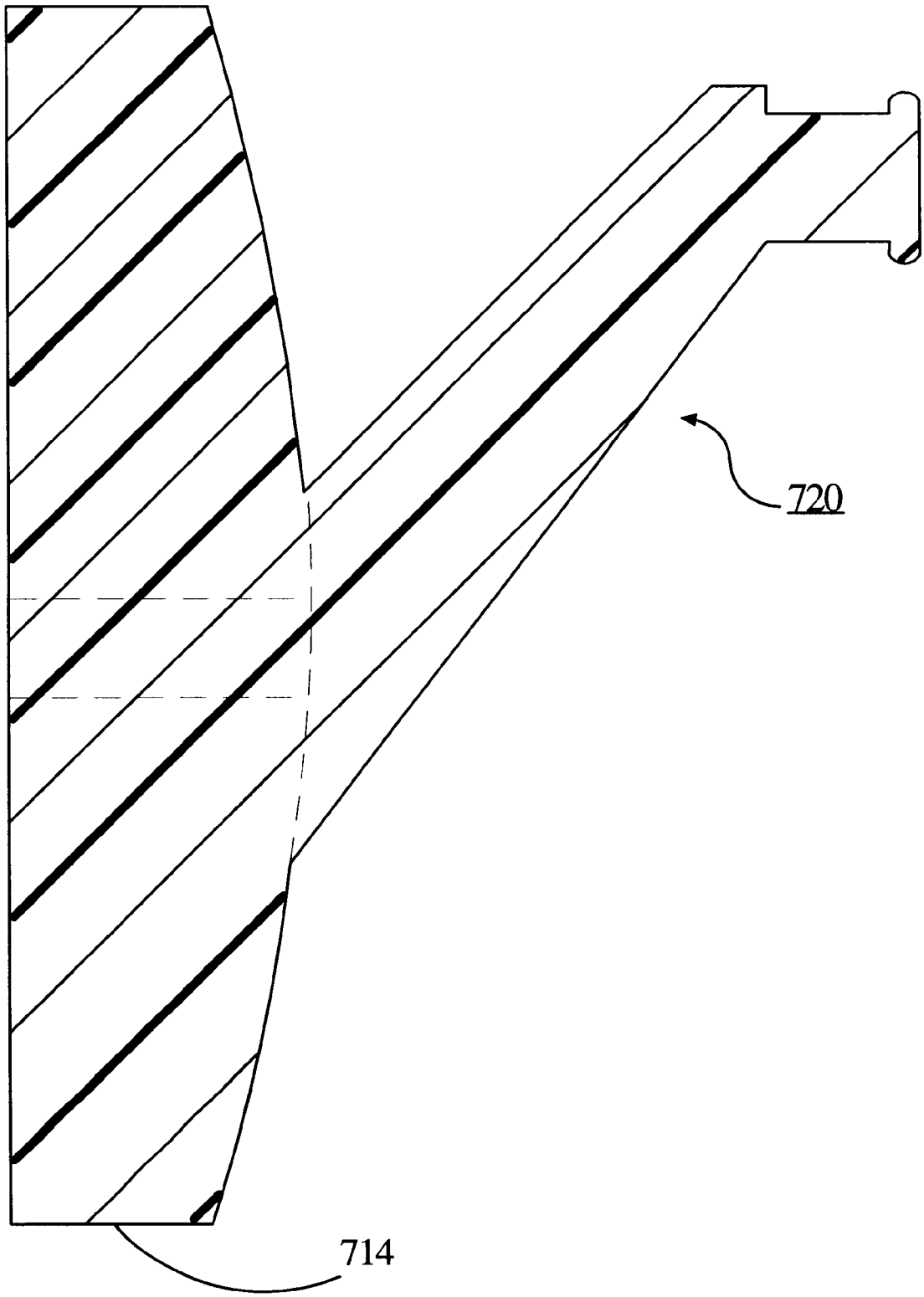
FIG. 7*a* is a cross-sectional view of a homogeneous or monolithic structure equivalent to one portion of a spindle clamp body with conventional stair rails support.
Figure 7B:
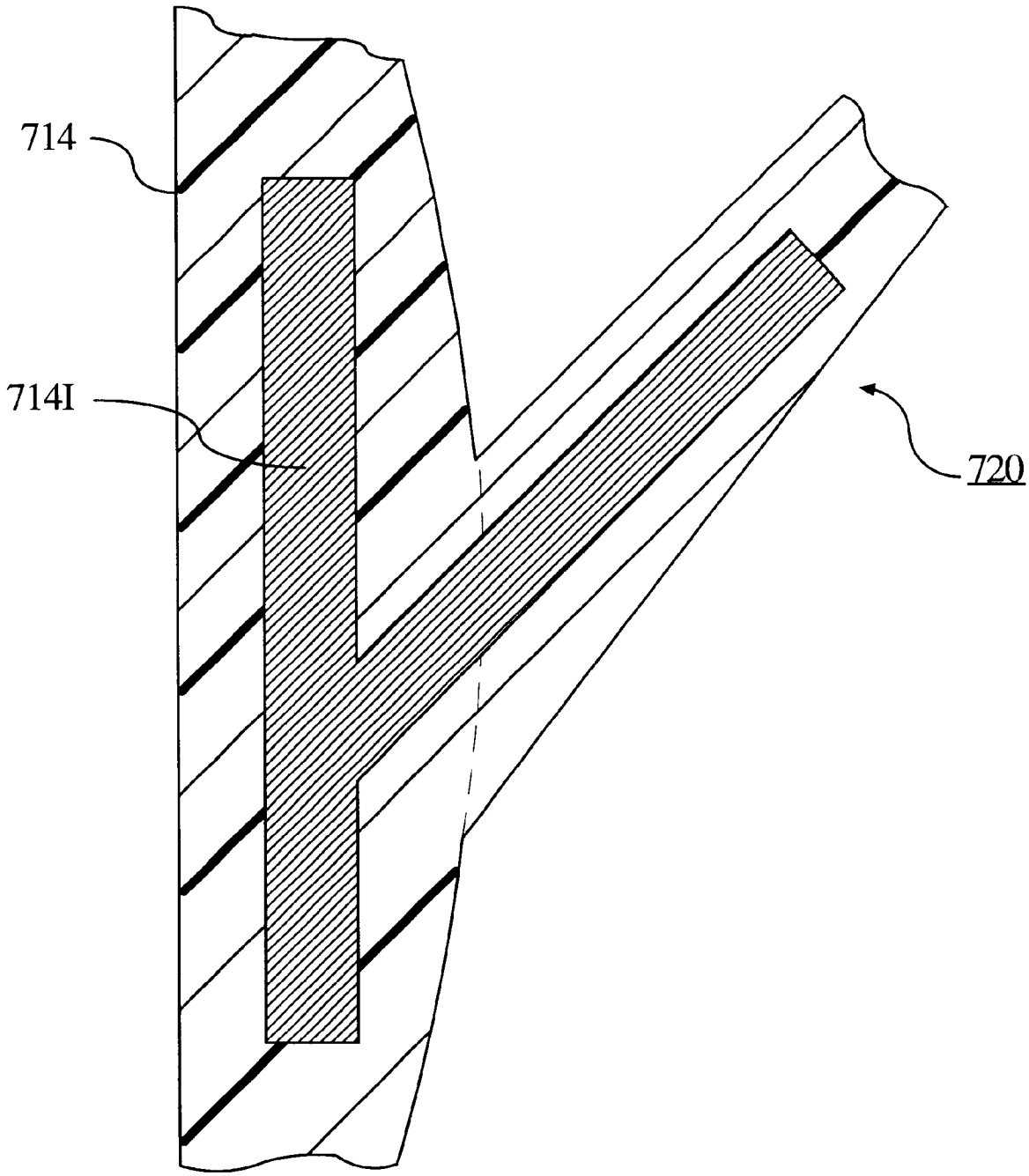
FIG. 7*b* illustrates a nonhomogeneous unit including an internal support.

As a further alternative, the projecting angle bracket may be cast or formed as part of the second body portion. FIG. 7*a* is a cross-section of a body portion 714 which includes a projecting 720 equivalent to the projecting portion of a conventional stair rail support, such as that shown AS 320 in FIGS. 3*a* and 6*a*. The projecting angle bracket portion 720 may be made of the same material as that of the second body portion 714, in which case a mold defining both the second body portion and the protruding angle bracket may be used. A reinforcing insert 714I of a stronger material may be included to reinforce the protruding angle bracket in this situation, as illustrated in FIG. 7*b*. The result of both of these methods for construction is that of monolithic second body portion with projecting angle bracket.

Figure 8:
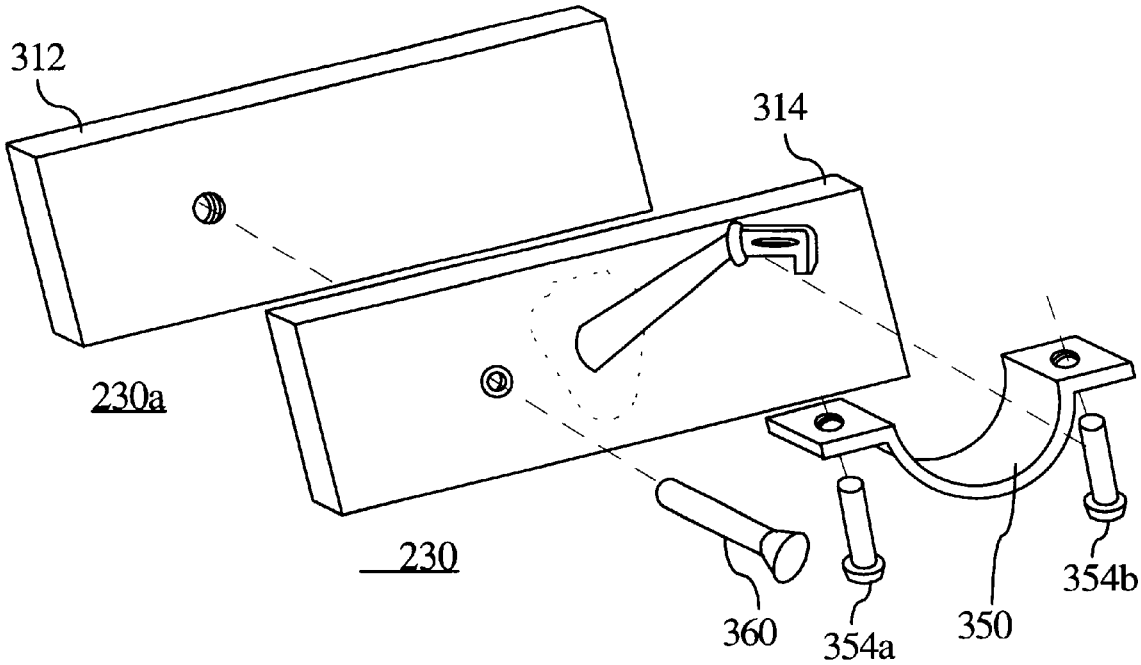
FIG. 8 illustrates one possible kit of parts according to an aspect of the invention.
Figure 8:
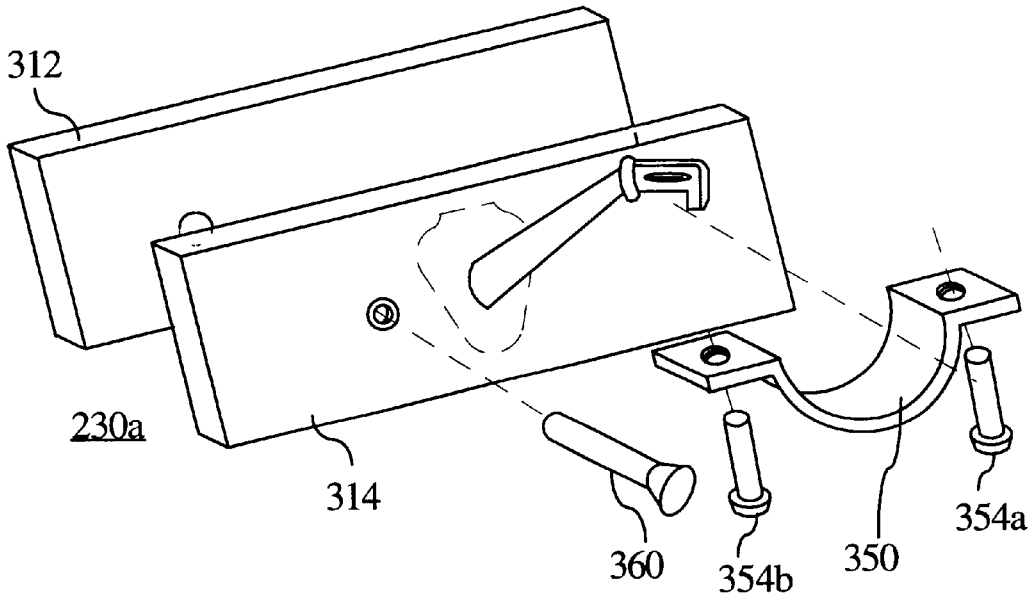

FIG. 8 illustrates a kit 230 including two clamp supports such as 230*a* of FIG. 3*a*. A kit of this sort may include three or more such clamps, if desired. Another possible kit of parts for support of a supplemental stair rail may include one spindle clamp of the type described in conjunction with FIG. 3*a*, 5*a*, 6*a*, or 7*a* or 7*b*, together with a clamp suitable for supporting a supplemental stair rail to a flat wall. The kit of parts illustrated in FIG. 8, or any of the other kits of parts according to the invention, may be supplemented with a sectionalized stair rail similar to those described in the prior art.

Figure 9:
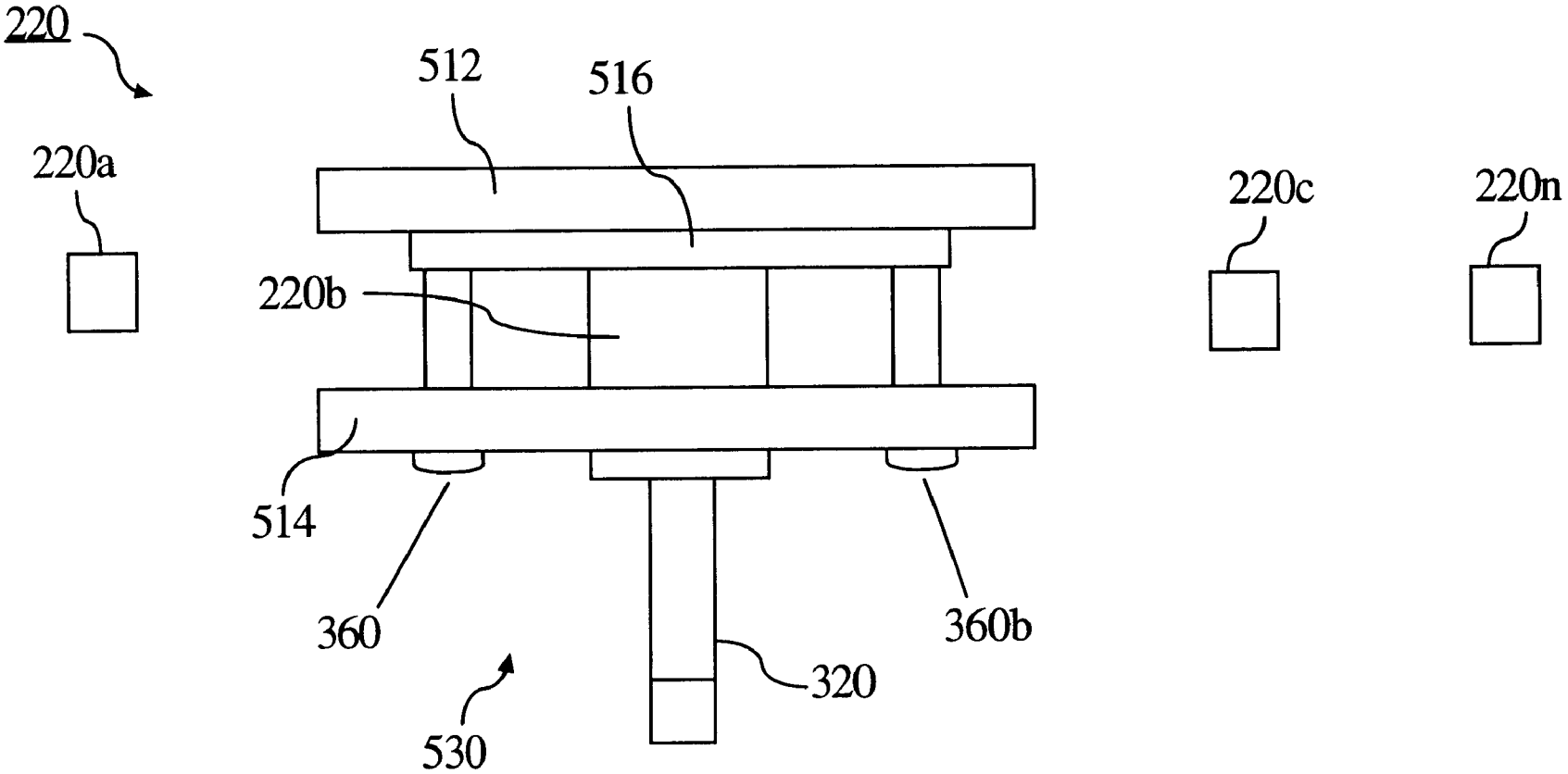
FIG. 9 illustrates the use of a supplemental rail support according to an aspect of the invention, used on a single spindle.

In some cases in which the stair rails are strong, as for example if they are made from iron or steel, it is possible to use supplemental rail supports which clamp to but a single spindle. FIG. 9 illustrates a supplemental rail support such as 530 of FIG. 5*a* mounted on a single spindle 220*b* of a set 220 of spindles. As illustrated in FIG. 9, the cross-section of the spindles is square at the location at which the support is fastened, rather than round. The square cross-section is not necessary to the use of the supplemental rail support, however, because when the rail support bracket 320 is fastened to a rail, rotation of the supplemental rail support 530 around the spindle is prevented. While the arrangement of FIG. 9 illustrates the use of supplemental rail support 530 of FIG. 5*a*, any other supplemental rail support in accordance with the invention may also be used.

It should be noted that the axes any two adjacent rail support spindles, with their spindle axes parallel, when taken together, define at least a local spindle plane. That is, a straight set of spindles defines a single spindle plane common to all the spindles, but a curved set of spindles defines a plurality of spindle plane segments, which together define a curved spindle plane.

Other embodiments of the invention will be apparent to those skilled in the art. For example, while the generally planar first and second body portions of the various clamps have been illustrated as being unadorned, they may be decorated in any desired manner. While depicted as generally rectangular, they may be square, oval, ovoid, or irregular in shape, or may have partially irregular and partially geometric shapes. While the first and second body portions of the various clamps have been illustrated as having the same general shape and dimensions, there is no particular need for this to be so, and they may have mutually disparate sizes andor shapes.

Thus, according to an aspect of the invention, a spindle clamp (230*a*, 230*b*: 530; 630) is for supporting a supplemental stair rail (340), as by means of at least one vertically oriented stair rail spindle (of set 220). The spindle clamp (230*a*, 230*b*: 530; 630) includes a generally planar first body portion (312; 512; 612) defining a first length (L) along a length axis (308L1; 508L1), a first width (W) along a width axis (308w1), and a first thickness (T) which may be less than either the first length (L) or the first width (W), so as to define first (312*f*) and second (312*b*) broad surfaces. The first width (W) of the first body portion (312; 512; 612) is of a dimension which is less than the inter-spindle dimension ((D) of the spaced-apart, mutually parallel stair-rail spindles (set 220), so that the first body portion (312; 512; 612), when oriented with the length axis (308L1; 508L1) parallel with the spindle axes (SA) or spindles (of set 220) and with the plane of first body portion (312; 512; 612) parallel with a plane (408; 508) containing the axes (SA) of the spindles (220), can pass between the spindles (220). The first body portion (312; 512; 612) also includes one portion (313; 513*a*, 513*b*; 613*a*, 613*b*) of a fastening device. A generally planar second body portion (314; 514; 614) defines a second length (L) along a length axis, a second width (W) along a width axis, and a second thickness which may be less than either the second length (L) or the second width (W) so as to define first and second broad surfaces. There is no necessary reason that either the first and second lengths or widths must be equal. The second body portion (314; 514; 614) also includes a second portion (360; 360, 360*b*) of the fastening device. The fastening device (313; 513*a*, 513*b*; 660*a*; 660*b*; 360; 360, 360*b*), when in use, tends to draw the first surface (312*b*) of the first body portion (312; 512; 612) toward the first surface (314*rs*) of the second body portion (314; 514; 614), whereby, when the first body portion (312; 512; 612) is located on one side of the plane (408; 508) containing the axes (SA) of the spindles (set 220) and the second body portion (314; 514; 614) is located on the other side of the plane (408; 508) containing the axes (SA) of the spindles (set 220), with a spindle therebetween, operating the fastening device tends to tighten the first (312; 512; 612) and second (314; 514; 614) body portions against opposite sides of the spindle to thereby stabilize the spindle clamp (230*a*, 230*b*: 530; 630). The spindle clamp (230*a*, 230*b*: 530; 630) further includes a rail support element (320; 720) projecting from the second side (312f; 314*fs*; 514*fs*; 614*fs*) of one of the first and second body portion (314; 514; 614)s, for engaging a stair rail (218; 340).

Also, according to another aspect of the invention, a spindle clamp (230*a*, 230*b*: 530; 630) according to an aspect of the invention is for supporting a supplemental stair rail (218; 340) by means of, or with the aid of, spaced-apart, mutually parallel, vertically oriented stair rail spindles (of set 220). The spindle clamp (230*a*, 230*b*: 530; 630) includes first (312; 512; 612) and second (314; 514; 614; 714) body portions and a projecting supplemental rail support (320; 720; 720). The first body portion (312; 512; 612) defines a first length (L) along (parallel with) a length axis (308L1), a first width (W) along (parallel with) a width axis (308W), and a first thickness (T) which may be less than either the first length (L) or the first width (W), so as to define a generally planar structure with first (312*b*) and second (312*f*) broad surfaces. In one embodiment of the invention, the first width (W) of the first body portion (312; 512; 612) is a dimension which is less than the inter-spindle dimension (D) of the spaced-apart, mutually parallel stair-rail spindles (of set 220), so that the first body portion (312; 512; 612), when oriented with its length axis (308L1) parallel with the (axes of the) spindles (220) and the plane of first body portion (312; 512; 612) parallel with a plane (408) containing the axes (SA) of the spindles (220), can pass between the spindles (220). The first length (308L1) of the first body portion (312; 512; 612) in this embodiment is greater than the inter-spindle dimension (D), so that the first body portion (312; 512; 612), when oriented with the first width axis (308W1) parallel with the (axes of the) spindles (220), and with the plane of the first body portion parallel with the plane (408; 508) of the spindles, cannot pass between the spindles (220). The first body portion (312; 512; 612) also includes one portion (313; 315) of a fastening device (313, 315, 360). In a particular embodiment, the portion (313; 315) is one of a clearance aperture (315) for a screw and a threaded aperture (313) for the screw (360). In a preferred embodiment, the threaded aperture (313) is a closed-ended aperture extending into the first body portion (312; 512; 612) from the first broad surface.

The second body portion (314; 514; 614) of the spindle clamp (230*a*, 230*b*: 530; 630) in this other embodiment of the invention is also generally planar, and defines a second length (L) along a length axis (308L2), a second width (W) along a width axis (308W2), and a second thickness which may be less than either the second length or the second width so as to define first (312*b*) and second (312*f*) broad surfaces. The second length (L) and second width (W) may be the same as, or different from, the first length (L) and first width (w), respectively. The second body portion (314; 514; 614) also includes a second portion (313, 315, 360) of the fastening device which in the one embodiment is the other one of the through (315) and the threaded (313) aperture for the screw (360). The fastening device (313, 315, 360), when in use, tends to draw the first surface (312*b*) of the first body portion (312; 512; 612) toward the first surface (314*rs*) of the second body portion (314; 514; 614), whereby, when the first body portion (312; 512; 612) is located on one side of the plane (408) containing the axes (SA) of the spindles (220) and the second body portion (314; 514; 614) is located on the other side of the plane (408) containing the axes (SA) of the spindles (220), operating the fastening device (313, 315, 360) tends to tighten the first (312; 512; 612) and second (314; 514; 614) body portions against opposite sides of the spindles (220) and thereby stabilizes the spindle clamp (230*a*, 230*b*: 530; 630). The spindle clamp (230*a*, 230*b*: 530; 630) further comprises a rail support element (320; 720) projecting from the second broad surface or side (312*f*) of one of the first body portion (312; 512; 612) and the first side (314*fs*) of the second body portion (314; 514; 516; 714) for engaging a stair rail (218). Most applications will require a set of two or more such spindle clamps (230*a*, 230*b*: 530; 630), or at least one such spindle clamp (230*a*, 230*b*: 530; 630) and a wall-mount support (not illustrated).

A method according to another aspect of the invention is for mounting a spindle clamp (230*a*, 230*b*: 530; 630) for supporting a supplemental stair rail (218;340) by means of spaced-apart, mutually parallel, vertically oriented stair rail spindles (of set 220), where each stair rail spindle defines an axis (SA), and the axes together define at least a local spindle plane (408; 508). Each spindle clamp (230*a*, 230*b*: 530; 630) includes (a) a first body portion (312; 512; 612), (b) a second body portion (314; 514; 614), and (c) a rail support (320; 720). The first body portion (312; 512; 612) is generally planar, and defines a first length (L) along a length axis, a first width (W) along a width axis, and a first thickness which may be less than either the first length (L) or the first width (W), so as to define first (312*b*) and second (312*f*) broad surfaces. The first width (W) of the first body portion (312; 512; 612) is a dimension which is less than the inter-spindle dimension (D) of the spaced-apart, mutually parallel stair-rail spindles (of set 220), so that the first body portion (312; 512; 612), when oriented with the length axis (308L1; 508L1) parallel with the spindles (220) and the plane of first body portion (312; 512; 612) parallel with a plane (408; 508) containing the axes (SA) of the spindles, can pass between the spindles. The first length (L) of the first body portion (312; 512; 612) is greater than the inter-spindle dimension (D), so that the first body portion (312; 512; 612), when oriented with the length axis (308L1; 508L1) perpendicular with the axes of the spindles and parallel with the spindle plane (408; 508), cannot pass between the spindles. The first body portion (312; 512; 612) also includes one portion (313) of a fastening device, which in one embodiment of the invention is a screw/threaded aperture combination. The second body portion (314; 514; 614) is generally planar, and defines a second length along a length axis, a second width along a width axis, and a second thickness which may be less than either the second length or the second width so as to define first and second broad surfaces. As with the other embodiments, the length, width and thickness of the second body portion in this embodiment may be different from those of the first body portion. The second body portion (314; 514; 614) also includes a second portion (315, 360) of the fastening device. The fastening device, when in use, tends to draw the first surface (312*b*) of the first body portion (312; 512; 612) toward the first surface (314*rs*) of the second body portion (314; 514; 614), so that, or whereby, when the first body portion (312; 512; 612) is located on one side of the plane (408; 508) containing the axes (SA) of the spindles (of set 220) and the second body portion (314; 514; 614) is located on the other side of the plane (408; 508) containing the axes (SA) of the spindles, operating the fastening device tends to tighten the first (312; 512; 612) and second body portion (314; 514; 614)s against opposite sides of the spindles and thereby stabilizes the spindle clamp (230*a*, 230*b*: 530; 630). The spindle clamp (230*a*, 230*b*: 530; 630) further includes a rail support element (320; 720) projecting from the second side (312*f*; 314*fs*; 514*fs*; 614*fs*) of one of the first and second body portion (314; 514; 614)s, for engaging a stair rail (218;340). The method compares the step of placing the first body portion (312; 512; 612) adjacent the spindle plane (408; 508), roughly between two mutually adjacent spindles (such as 220*a* and 220*b*), with the first length axis (308L1; 508L1) parallel with the axes (SA) of the spindles (220). The next step includes moving the first body portion (312; 512; 612) perpendicularly toward and through the spindle plane (arrow 342, 540), without causing the second body portion (314; 514; 614) to pass through the spindle plane (408; 508). The first body portion (312; 512; 612) is rotated so as to bring the first length axis (308L1; 508L1) perpendicular to the spindle axes (SA) and parallel with the spindle plane (408; 508). Since the length of the body section exceeds the inter-spindle spacing (D), at least one of the spindles should lie adjacent the first body portion (312; 512; 612). In general, this rotation of the first body portion (312; 512; 612) constitutes rotation in the plane of the first body portion (312; 512; 612). The second body portion (314; 514; 614) is placed in a position in which the second length axis (308L2) is roughly parallel with the first length axis (308L1; 508L1), and on the opposite side of the spindle plane from the first body portion (312; 512; 612), if the second body portion (314; 514; 614) is not already in such a position. In the given positions, the at least one of the spindles (of set 220) should lie between the first (312; 512; 612) and second (314; 514; 614) body portions. The fastening device (313, 315, 360) is then operated or tightened to thereby draw the first (312; 512; 612) and second (314; 514; 614) body portions toward each other with the at least one of the spindles located between the first (312; 512; 612) and second (314; 514; 614) body portions, to thereby fasten the spindle clamp (230*a*, 230*b*: 530; 630) to the at least one spindle. A stair rail (340) can then be fastened to the rail support element (320; 720).

What is claimed is:

1. A spindle clamp for supporting a supplemental stair rail by means of spaced-apart, mutually parallel, vertically oriented stair rail spindles, said spindle clamp comprising:

a generally planar first body portion defining a first length along a length axis, a first width along a width axis, and a first thickness which may be less than either said first length or said first width, so as to define first-and second broad surfaces, said first width of said first body portion being a dimension which is less than the inter-spindle dimension of said spaced-apart, mutually parallel stair-rail spindles, so that said first body portion, when oriented with said length axis parallel with said spindles and the plane of first body portion parallel with a plane containing the axes of said spindles, can pass between said spindles, and said first length of said first body portion being greater than said inter-spindle dimension, so that said first body portion, when oriented with said first length axis dimension perpendicular with said spindles and parallel with the plane of the spindles, cannot pass between said spindles, said first body portion also including one portion of a fastening device;

a generally planar second body portion defining a second length along a length axis, a second width along a width axis, and a second thickness which may be less than either said second length or said second width so as to define first and second broad surfaces, said second body portion also including a second portion of said fastening device, said fastening device, when in use, tending to draw said first surface of said first body portion toward said first surface of said second body portion, whereby, when said first body portion is located on one side of said plane containing the axes of said spindles and said second body portion is located on the other side of said plane containing the axes of said spindles with at least one of said spindles therebetween, operating said fastening device tends to tighten said first and second body portions against opposite sides of said spindles and thereby stabilize said spindle clamp; and a rail support element projecting from said second side of one of said first body portion and second body portion for engaging a stair rail.

2. A spindle clamp according to claim 1, wherein said one portion of said fastening device comprises a threaded aperture extending into said first body portion from said first broad surface of said first body portion.

3. A spindle clamp according to claim 2, wherein said threaded aperture is closed-ended.

4. A spindle clamp according to claim 1, wherein said rail support element is a monolithic component of said one of said first and second body portion.

5. A method for mounting a spindle clamp for supporting a supplemental stair rail by means of spaced-apart, mutually parallel, vertically oriented stair rail spindles, each defining an axis, and the axes together defining at least a local spindle plane, wherein said spindle clamp includes (a) a generally planar first body portion defining a first length along a length axis, a first width along a width axis, and a first thickness which may be less than either said first length or said first width, so as to define first and second broad surfaces, said first width of said first body portion being a dimension which is less than the inter-spindle dimension of said spaced-apart, mutually parallel stair-rail spindles, so that said first body portion, when oriented with said length axis parallel with said spindles and the plane of first body portion parallel with a plane containing the axes of said spindles, can pass between said spindles, and said first length of said first body portion being greater than said inter-spindle dimension, so that said first body portion, when oriented with said first axis dimension perpendicular with said spindles, cannot pass between said spindles, said first body portion also including one portion of a fastening device, (b) a generally planar second body portion defining a second length along a length axis, a second width along a width axis, and a second thickness which may be less than either said second length or said second width so as to define first and second broad surfaces, said second body portion also including a second portion of said fastening device, said fastening device, when in use, tending to draw said first surface of said first body portion toward said first surface of said second body portion, whereby, when said first body portion is located on one side of said plane containing the axes of said spindles and said second body portion is located on the other side of said plane containing the axes of said spindles, operating said fastening device tends to tighten said first and second body portions against opposite sides of said spindles and thereby stabilize said spindle clamp, and (c) said spindle clamp further comprising a rail support element projecting from said second side of one of said first body portion and second body portion for engaging a stair rail, said method comprising the steps of:

placing said first body portion adjacent said spindle plane, roughly between two mutually adjacent spindles, with said first length axis parallel with the axes of said spindles;

moving said first body portion perpendicularly toward and through said spindle plane, without causing said second body portion to pass through said spindle plane;

rotating said first body portion so as to bring said first length axis perpendicular to said spindle axes and parallel with said spindle plane, whereby at least one of said spindles lies adjacent said first body portion;

placing said second body portion in a position in which said second length axis is roughly parallel with said first length axis, and on the opposite side of said spindle plane from said first body portion, if said second body portion is not already in such a position, whereby said at least one of said spindles lies between said first and second body portions; and tightening said fastening device to thereby draw said first and second body portions toward each other with said at least one of said spindles between said first and second body portions, to thereby fasten said spindle clamp to said at least one spindle.

6. A method according to claim 5, further comprising the step of fastening a rail to said rail support element of said spindle clamp.

7. A spindle clamp for supporting a supplemental stair rail by means of at least one vertically oriented stair rail spindle, said spindle clamp comprising:

a generally planar first body portion defining a first length along a length axis, a first width along a width axis, and a first thickness which may be less than either said first length or said first width, so as to define first and second broad surfaces, said first width of said first body portion being a dimension which is less than the inter-spindle dimension of said spaced-apart, mutually parallel stair-rail spindles, so that said first body portion, when oriented with said length axis parallel with said spindles and the plane of first body portion parallel with a plane containing the axes of said spindles, can pass between said spindles, said first body portion also including one portion of a fastening device;

a generally planar second body portion defining a second length along a length axis, a second width along a width axis, and a second thickness which may be less than either said second length or said second width so as to define first and second broad surfaces, said second body portion also including a second portion of said fastening device, said fastening device, when in use, tending to draw said first surface of said first body portion toward said first surface of said second body portion, whereby, when said first body portion is located on one side of said plane containing the axes of said spindles and said second body portion is located on the other side of said plane containing the axes of said spindles with a spindle therebetween, operating said fastening device tends to tighten said first and second body portions against opposite sides of said spindle and thereby stabilize said spindle clamp;

said spindle clamp further comprising a rail support element projecting from said second side of one of said first body portion and second body portion for engaging a stair rail.

* * * * *